United States Patent [19]

Denker et al.

[11] 4,249,911

[45] Feb. 10, 1981

[54] COMBUSTIBLE FUEL COMPOSITION

[75] Inventors: Bernard L. Denker, Key Biscayne, Fla.; Franklin D. Hoffert, Mountainside, N.J.

[73] Assignee: Hydrocarbon Research, Inc., Lawrenceville, N.J.

[21] Appl. No.: 12,428

[22] Filed: Feb. 15, 1979

[51] Int. Cl.[3] ..... C10L 1/18

[52] U.S. Cl. ..... 44/53

[58] Field of Search ..... 44/51, 53, 56

[56] References Cited

U.S. PATENT DOCUMENTS

| | | | |
|---|---|---|---|
| 776,365 | 11/1904 | Spelman | 44/51 |
| 1,444,665 | 2/1923 | Crommett | 44/51 |
| 2,590,733 | 3/1952 | Stillman | 44/51 |
| 2,668,757 | 2/1954 | Hansley | 44/51 |
| 2,754,267 | 7/1956 | Bondi | 44/51 |
| 2,780,538 | 2/1957 | Chilton | 44/51 |
| 2,943,064 | 6/1960 | Lipkin | 44/51 |
| 3,620,698 | 11/1971 | Schlinger et al. | 44/51 |
| 3,642,608 | 2/1972 | Roach | 44/51 |
| 3,762,887 | 10/1973 | Clarcey et al. | 44/51 |

*Primary Examiner*—Winston A. Douglas
*Assistant Examiner*—J. V. Howard
*Attorney, Agent, or Firm*—Michael A. Jacobs

[57] ABSTRACT

A fuel composition comprising carbon black and a combustible liquid such as lower alkyl alcohols having 1 to 4 carbon atoms or liquid hydrocarbons is provided. The composition is formed by adding a sufficient amount of carbon black to the combustible liquid without thereby causing an increase in the volume of the mixture by more than about five percent (5%).

11 Claims, 2 Drawing Figures

COMBUSTIBLE FUEL COMPOSITION

BACKGROUND OF THE INVENTION

1. Field of the Invention

The present invention is related to a novel composition of matter and the method of preparing same. More specifically, the present invention is directed to a novel fuel composition which contains carbon black and a combustible liquid. In addition, the present invention is also related to a method of increasing the heating value of the combustible liquid.

2. Description of the Prior Art

Some combustible liquids such as menthol have a low heating value on a volumetric basis. Its heating value is approximately 63,900 BTU/gallon, as compared to 136,000 BTU/gallon for kerosene or 130,000 BTU/gallon for gasoline. When this low heating value is coupled with the cost of shipping and storing, the use of methanol as a fuel is usually uneconomic.

The combination of a carbonaceous solid material such as coal with liquid fuel materials to form a composite fuel is well known, as exemplified in the following patents.

U.S. Pat. No. 776,365 discloses a composite fuel and a method of making same. The fuel comprises a finely-ground carbonaceous solid matter, such as coal, which is mixed during the grinding with molasses, crude petroleum, or a similar inflammable semi-liquid. The compound is then thinned to the density of ordinary fuel-oil by adding thereto a fluid such as crude alcohol or a light hydrocarbon.

U.S. Pat. No. 2,590,733 discloses a stable suspension of colloidal sized coal particles suspended in a liquid medium. The liquid may be fuel oil, paints, drying oils such as linseed, tung, or mehaden oils, and lubricating oil. The solid material is first ground as finely as possible and mixed with the liquid medium to form a suspension in which the solid particles are completely and uniformly dispersed throughout the liquid medium.

U.S. Pat. No. 2,668,757 discloses a method of preparing nonaqueous carbon dispersions. The method comprises forming in an agitated body of an inert organic liquid such as mineral oil an alkali metal soap of a higher fatty acid and agitating the resulting mixture with finely divided amorphous carbon. Such dispersions of amorphous carbons and liquids are useful for high heat value fuels.

U.S. Pat. No. 2,754,267 is directed to a fluid carbon black suspension which comprises a refined mineral oil having suspended therein between about ten percent (10%) to about forty percent (40%) by weight of the total suspension of carbon black particles. The particles weight of the total suspension of carbon black particles. The particles are coated with at least about a unimolecular coating of an oil-soluble hydrolyzed copolymer. As noted at column 3, lines 5 through 6 in this patent, the presence of the oil-soluble copolymeric materials is essential to the suspension.

U.S. Pat. No. 3,620,698 discloses a process of producing synthesis gas from a slurry of particulate solid carboniferous fuels in a water or a hydrocarbon liquid fuel. The slurry is mixed with a stream of an oxidizing gas at the tip of a burner to form an atomized dispersion of water, hydrocarbon liquid fuel, oxidizing gas, and solid carboniferous fuel. Under synthesis gas generating conditions, the atomized dispersion is reacted to produce a gaseous mixture of hydrogen and carbon monoxide.

According to this process, pumpable slurry feeds of low-cost solid carboniferous fuels may be gasified in a synthesis gas generator without being preheated.

U.S. Pat. No. 3,642,608 is related to a process for de-ashing coal. The process comprises intimately contacting the coal in particulate form with a highly aromatic hydrocarbon petroleum refinery byproduct stream as a solvent to produce a coal solution having a low viscosity which can be de-ashed by settling and/or filtering. The coal may then be used for the production of carbon black.

U.S. Pat. No. 3,762,887 is directed to a liquid fuel composition having as its sole constituents, particulate coal and water. The particulate coal and water are mixed to form a homogeneous slurry which can be handled stored, pumped and burned in substantially the same manner as conventional liquid fuels. The coal and water in the slurry have the relative proportions of between fifty-four (54) and sixty-nine (69) percent by volume of coal and forty-six (46) and thirty-one (31) percent by volume water.

The above-listed patents show that while the combination of a solid carbonaceous material with liquid fuel is known, the composition and process of the present invention have not been mentioned or suggested.

It has been discovered that when up to about twenty percent (20%) weight of carbon black particles is added to a combustible liquid such as methanol or kerosene, there is and insignificant increase (no more than five percent (5%)) in the volume of the mixture. Such a carbon black/combustible liquid mixture has an increased heating value over that of the liquid alone. Thus, combustible liquids having low heating values may be advantageously used as fuels when carbon black particles have been added thereto to increase the heating value.

SUMMARY OF THE INVENTION

The present invention relates to a fuel composition which comprises a mixture of carbon black particles and a combustible liquid, and the process of forming such a composition. In addition, the present invention is also related to a method of increasing the heating value of a combustible liquid.

According to the present invention, carbon black particles may be mixed with a combustible liquid such as lower alkyl alcohols e.g. methanol or hydrocarbon liquids e.g. kerosene or naphtha to form a pumpable liquid without causing any substantial increase (i.e. five percent (5%) or less) in the volume of the mixture. The carbon black particles may be present in an amount of up to about twenty percent (20%) by weight of the mixture. While the mixing can be accomplished at room temperatures, i.e. from about 20° to about 25° C., it may be performed at higher temperatures, provided that the temperature does not exceed the boiling point of the combustible liquids.

This fuel composition invention comprising carbon black mixed with a combustible liquid provides a storable clean-burning liquid fuel for those applications where use of such type fuel is essential, such as for gas turbine combustion applications in densely populated areas, and containing acceptably low levels of sulfur. Fuel compositions produced in accordance with this invention are clean-burning and contain insignificant concentrations of nitrogen and sulfur.

DETAILED DESCRIPTION OF THE INVENTION

Figure 1:
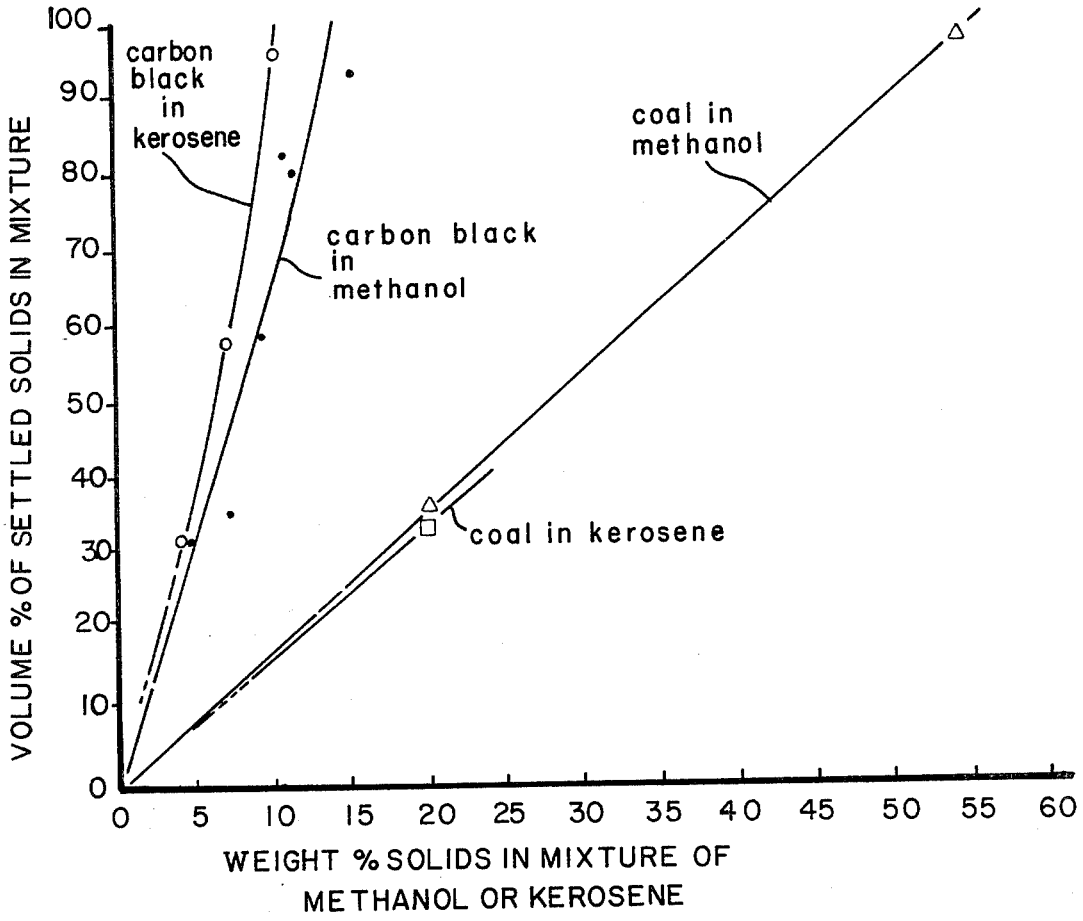
FIG. 1 illustrates the relationships between volume percent of settled solids in carbon black/combustible liquid mixture and the weight percent solids in the mixture of methanol or kerosene.

According to the present invention, a fuel composition comprising a mixture of carbon black particles and a combustible liquid has a higher heating value on a volumetric basis than that of the liquid alone. The effective (usable) heating value of a fuel composition or mixture is its net or lower value, i.e. not including the heat evolved in condensing water after combustion. Because carbon black is low in hydrogen content, usually containing about 0.2 to 0.3 percent hydrogen, the higher and lower heating values of carbon black are substantially the same. Therefore, carbon black has an enhanced value as a fuel component or supplement because all the potential heat in the carbon black is recovered, whereas it is possible to recover only about 90–93 percent of the potential heat in a hydrogen-containing fuel. Thus, the effectiveness of carbon black as a fuel component is enhanced further. It has been found that when carbon black is added to the combustible liquid, there is no substantial increase (from about 1 percent to about 5 percent) in the volume of the mixture, up to a carbon black content of about 20 percent by weight of the mixture. As a result, the heating value of the liquid is increased although the volume remains substantially the same. Suitable combustible liquids include low sulfur-containing hydrocarbon liquids such as kerosene and naphtha and lower alkyl alcohols, preferably those having 1 to 4 carbon atoms. Specific examples of the alkyl alcohols include methanol, ethanol, propanol, n-butanol, and isobutanol. Among the above-named combustible liquids, methanol and kerosene are preferred, with methanol being most preferred.

Carbon black particles which may be used in this invention have a particle size of from about 5 to about 600 milli microns, more preferably from about 8 to about 100 milli microns, and a surface area of from about 5 to about 1,000 $m^2/g$, more preferably from about 25 to about 250 $m^2/g$. Among the various carbon blacks which may be used in the present invention, furnace process oil blacks are preferred, although any carbon black is operable.

In a preferred embodiment of the fuel composition of the present invention, methanol is used as the combustible liquid and the carbon black is present in the composition in an amount of from about 0.05 to about 18 percent by weight.

In another preferred embodiment of the fuel composition of the present invention, the hydrocarbon liquid is kerosene having a gravity rate of about 30–50 °API and the carbon black is present in the composition in an amount of from about 0.5 to about 10 percent by weight, more preferably approaching the condition whereby the liquid is "saturated" with the carbon black as reliably as possible to avoid exceeding such a saturation condition, such as 8–20 percent by weight carbon black in liquid.

The fuel composition of this invention may be prepared by adding the carbon black particles to the combustible liquid and mixing to form the product. It is of importance to note that by adding the carbon black to the liquid, the volume of the mixture is not substantially increased until the mixture contains about 20 percent by weight of carbon black particles. Visual observations of the carbon/black liquid mixture show that the carbon black appears to "dissolve" or "disappear" into the liquid, involving no significant volume increase in the mixture. When coal particles are added to a combustible liquid such as methanol or kerosene, the particles are not dissolved therein, thus causing an increase in the total volume of the mixture. In addition, a carbon black-methanol mixture appears to be pumpable whereas a mixture of coal and methanol has the appearance of a sludge, and can be pumped only with difficulty, if at all.

The present invention further provides a method for increasing the heating value of a combustible liquid comprising adding thereto a sufficient amount of carbon black particles so that the total volume of the liquid and carbon black particles mixture is not measurably increased, and mixing throughly to form the product. The increase in volume of the mixture is limited to from about 1 to about 5 percent, more preferably from about 1 to about 3 percent. Useful combustible liquids include kerosene, naphtha, and alkyl alcohols having 1 to 4 carbon atoms. Examples of suitable alcohols include those mentioned above, i.e. methanol, ethanol, propanol, n-butanol, and iso-butanol.

As has been mentioned, the heating value of combustible hydrocarbon liquids on a volumetric basis can be increased substantially by adding thereto carbon black particles. For example, for a carbon black/methanol mixture, wherein the carbon black is present in an amount of about 15 percent by weight, the heating value of the mixture has been found to be greater than that of methanol alone by about 33 percent. The heating value for methanol alone is 63,900 BTU/gallon. The calculated heating value of such a carbon black/methanol mixture is about 85,000 BTU/gallon. This increase in heating value without increasing the fuel mixture volume is significant, in that it makes the use of methanol as a fuel more economically feasible.

In the instance where carbon black particles are added to kerosene without causing an increase in the total volume of mixture, i.e., the kerosene is saturated with the carbon black particles, the heating value of the mixture exceeds that of kerosene by about 10 percent.

The addition of the carbon black particles to the hydrocarbon liquid may be performed at any suitable temperature, providing that the temperature is below the boiling point of the liquid. Thus, the mixing may be conveniently conducted at room temperature, i.e., from about 20° to about 25° C.

The present invention is further illustrated in the following examples. However, it must be noted that the examples are for illustrative purposes only and should not be construed to be limiting.

EXAMPLE 1

Fifty cc of methanol was placed in a graduated cylinder at room temperature. 5 grams of carbon black particles obtained from an oil furnace combustion process having a particle size range of from about 8 milli microns to about 100 milli microns and a surface area of from about 25 $m^2/gm$ to about 250 $m^2/g$ were added to the methanol and stirred. The mixture was allowed to settle and the volume of the mixture was noted. The height of the settled floc was also recorded. If the height of the floc was less than 25 cc, another 5 grams of carbon black particles were added. This procedure was repeated until the floc height was equal to the volume of the methanol, whereby the methanol was "saturated" with the carbon black and without causing any substantial increase, i.e. less than 5%, in the volume of the mixture.

Figure 2:
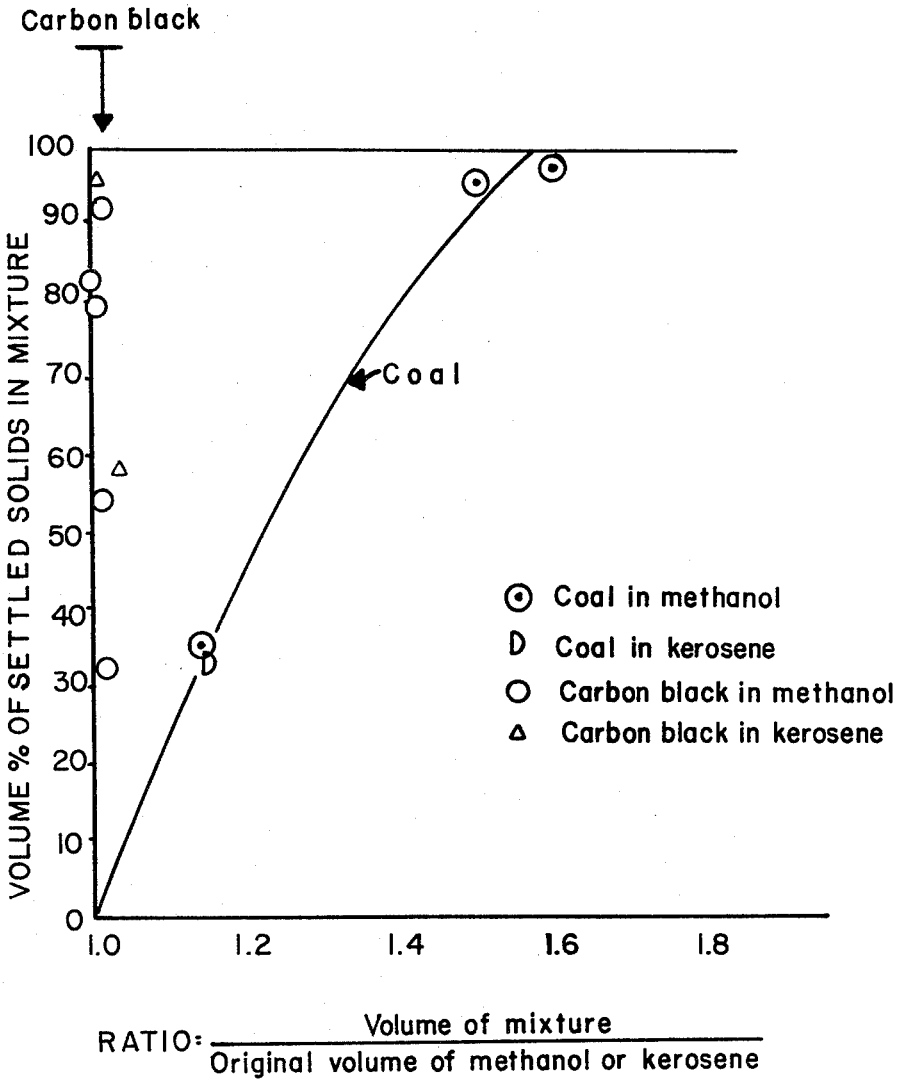
FIG. 2 illustrates the relationships between volume percent of settled solids in the solids/liquid mixture and the ratio of the volume of mixture/original volume of methanol or kerosene.

The results obtained in this example are summarized in FIGS. 1 and 2.

EXAMPLE 2

The procedure outlined in Example 1 was repeated, except kerosene having about 44 °API gravity was used as the combustible liquid instead of methanol. The results obtained are summarized in FIGS. 1 and 2.

EXAMPLE 3

The procedure outlined in Example 1 was repeated except that carbon black particles were replaced by pulverized coal added to methanol. The coal was dry, having 2 weight percent surface moisture, and ground to such a particle size so that all, i.e. 100 percent, passed through 20 mesh screen, U.S. Sieve Series. The results obtained are presented in FIGS. 1 and 2.

EXAMPLE 4

The procedure outline in Example 3 was repeated except that kerosene was used as the combustible liquid mixed with the coal. The results obtained are presented in FIGS. 1 and 2.

From FIGS. 1 and 2, it may be observed that coal particles caused significant increases in the volume of the coal/kerosene mixture, which means that there was little or no "dissolving" of the coal in either the methanol or in the kerosene liquid.

From the above description, it is clear that the present invention provides a novel fuel composition comprising carbon black particles and a combustible liquid, such as methanol and/or kerosene. Furthermore, the present invention provides a method for easily increasing the heating value of such combustible liquids, thus making the shipping and storing of such liquids and their use as a fuel more economically feasible.

What is claimed is:

1. A fuel composition comprising a mixture of carbon black particles and a combustible liquid selected from the group consisting of alkyl alcohols having 1 to 4 carbon atoms, the carbon black being present in an amount of up to about twenty percent (20%) by weight of the composition.

2. The composition of claim 1 wherein the carbon black has a particle size of from about 50 to about 600 milli microns and a surface area of from about 5 to about 1,000 $m^2/g$.

3. The composition of claim 2 wherein the combustible liquid is methanol and the carbon black is present in an amount of from about 0.5 percent to about 18 percent by weight of the composition.

4. The composition of claim 3 wherein the carbon black is present in an amount of from about 5 percent to about 15 percent by weight.

5. A method for preparing a fuel composition comprising the steps of: (a) adding a sufficient amount of carbon black particles to a combustible liquid selected from the group consisting of alkyl alcohols having 1–4 carbon atoms without causing an increase of more than 5% in volume of the liquid and particles mixture; and (b) mixing said particles and liquid together.

6. The method of claim 5 wherein the carbon black is present in an amount of from about 0.5 percent to about 20 percent by weight.

7. A method for increasing the heating value of a combustible liquid comprising adding to a volume of the liquid, a sufficient amount of carbon black particles whereby the total volume of the liquid and the carbon black mixture is not increased by more than 5%, mixing said volume of liquid and carbon black, the combustible liquid being selected from the group consisting of alkyl alcohols having 1–4 carbon atoms.

8. A method of claim 7 wherein the carbon black is present in an amount of from about 0.5% to about 18% by weight, and the combustible liquid is methanol.

9. The method of claim 6 wherein the combustible liquid is methanol.

10. The fuel composition of claim 1, wherein the carbon black has a particle size of between about 8–100 millimicrons and a surface area between about 25–250 $m^2/g$.

11. The composition of claim 10 wherein the alcohol is methanol.

* * * * *